US010082746B2

(12) United States Patent
Hayashi et al.

(10) Patent No.: US 10,082,746 B2
(45) Date of Patent: Sep. 25, 2018

(54) IMAGE FORMING APPARATUS

(71) Applicant: KYOCERA Document Solutions Inc., Osaka (JP)

(72) Inventors: Kenichi Hayashi, Osaka (JP); Hiroki Tanaka, Osaka (JP)

(73) Assignee: KYOCERA DOCUMENT SOLUTIONS INC. (JP)

( * ) Notice: Subject to any disclaimer, the term of this patent is extended or adjusted under 35 U.S.C. 154(b) by 0 days.

(21) Appl. No.: 15/591,853

(22) Filed: May 10, 2017

(65) Prior Publication Data

US 2017/0329254 A1 Nov. 16, 2017

(30) Foreign Application Priority Data

May 13, 2016 (JP) ..... 2016-097463

(51) Int. Cl.

*G03G 15/06* (2006.01)
*G03G 15/08* (2006.01)
*G03G 15/00* (2006.01)

(52) U.S. Cl.

CPC ..... *G03G 15/065* (2013.01); *G03G 15/0808* (2013.01); *G03G 15/5058* (2013.01); *G03G 2215/00059* (2013.01)

(58) Field of Classification Search

CPC ..... G03G 15/5058
See application file for complete search history.

(56) References Cited

U.S. PATENT DOCUMENTS

2007/0134012 A1* 6/2007 Suzuki ..... G03G 15/50 399/49
2014/0010560 A1 1/2014 Obara et al.
2015/0071664 A1* 3/2015 Hirai ..... G03G 15/10 399/53

FOREIGN PATENT DOCUMENTS

JP 2014-013269 1/2014

* cited by examiner

*Primary Examiner* — Clayton E Laballe
*Assistant Examiner* — Jas Sanghera

(57) ABSTRACT

In an image forming apparatus, a controller (a) determines a bright potential of a photoconductor drum at calibration, (b) adjusts a development bias and thereby determines as an intermediate reference development bias value a value of the development bias so that a toner density based on an output of a reflection-type optical sensor is equal to an intermediate reference density lower than a target density, (c) determines as an intermediate reference effective potential a difference between the intermediate reference development bias value and the bright potential at calibration, and (d) determines a development bias value corresponding to the target density by linear interpolation based on the intermediate reference effective potential and a virtual zero density effective potential. The virtual zero density effective potential is a difference between a development bias and a bright potential of the photoconductor drum when a transmission density is virtually zero.

3 Claims, 8 Drawing Sheets

IMAGE FORMING APPARATUS

CROSS-REFERENCE TO RELATED APPLICATIONS

This application relates to and claims priority rights from Japanese Patent Application No. 2016-097463, filed on May 13, 2016, the entire disclosures of which are hereby incorporated by reference herein.

BACKGROUND

1. Field of the Present Disclosure

The present disclosure relates to an image forming apparatus.

2. Description of the Related Art

In an image forming apparatus such as a printer or a multi function peripheral, a toner adhesion amount to a photoconductor drum is not constant and thereby a toner density in a formed image is not constant even if image forming is performed in a same process condition, due to change of temperature and humidity in the apparatus, wear by use of the photoconductor drum, change of a charging characteristic of toner when stocked or not in use, deterioration of a component other than the photoconductor drum. For solving this problem, in such image forming apparatus, calibration is performed to adjust the toner adhesion amount.

In general, in the calibration, a solid toner patch (i.e. a toner pattern with a uniform constant density in a patch) corresponding to a target toner adhesion amount is formed on an intermediate transfer belt; a toner adhesion amount of the toner patch is optically detected by irradiating the toner patch with light and receiving reflection light thereof from the toner patch; and a process condition such as a charging voltage, a development bias voltage and/or an exposure amount is adjusted on the basis of the detection result so as to make the toner adhesion amount be equal to a target value.

However, in case of calibration using such a reflection-type optical sensor as mentioned, a toner adhesion amount in a high density range is sometimes not detected accurately. This is because a toner patch with a higher density range tends to be piled more strongly in a height direction and therefore in a high density range, an intensity of the reflection light increases only a little even if an actual toner density is increased. In particular, incoming light to black toner is absorbed by the black toner and therefore this tendency strongly appears on the black toner.

When adjusting a specific density in a high density range to a target density, the development bias is usually adjusted, but as mentioned, the reflection-type optical sensor does not accurately detect the toner adhesion amount and therefore the development bias set as a process condition is fluctuated and it causes unstable image quality.

An image forming apparatus uses a non-solid toner patch and thereby keeps a toner amount per unit area and detects the reflection light, and consequently accurately measures a toner density in a high density range.

However, in the aforementioned apparatus, using the non-solid toner patch causes larger fluctuation of the toner adhesion amount due to fluctuation of surface potential of the photoconductor drum than that of a solid toner patch. In addition, in the aforementioned apparatus, when a capacitance of the photoconductor drum changes due to change of usage environment such as temperature and/or humidity or change of a coating thickness of the photoconductor drum by use, this change of the capacitance affects an edge electric field of the non-solid toner patch more strongly than that of a solid toner patch. As mentioned, in some cases, the aforementioned apparatus can not accurately measure the toner density.

SUMMARY

An image forming apparatus according to an aspect of the present disclosure includes a photoconductor drum, a development roller, an image carrier, a reflection-type optical sensor, and a controller. The development roller is configured to supply toner to an electrostatic latent image on the photoconductor drum. The image carrier is configured to carry a toner patch transferred from the photoconductor drum. The reflection-type optical sensor is configured to irradiate the toner patch with light and receive reflection light from the toner patch. The controller is configured to set a development bias applied to the development roller. Further, the controller (a) determines a bright potential of the photoconductor drum at calibration, (b) adjusts the development bias and thereby determines as an intermediate reference development bias value a value of the development bias so that a toner density based on an output of the reflection-type optical sensor is equal to an intermediate reference density lower than a target density, (c) determines as an intermediate reference effective potential a difference between the intermediate reference development bias value and the bright potential at calibration, and (d) determines a development bias value corresponding to the target density by linear interpolation based on the intermediate reference effective potential and a virtual zero density effective potential, the virtual zero density effective potential being a difference between a development bias and a bright potential of the photoconductor drum when a transmission density is virtually zero.

These and other objects, features and advantages of the present disclosure will become more apparent upon reading of the following detailed description along with the accompanied drawings.

DETAILED DESCRIPTION

Hereinafter, an embodiment according to an aspect of the present disclosure will be explained with reference to drawings.

Figure 1:
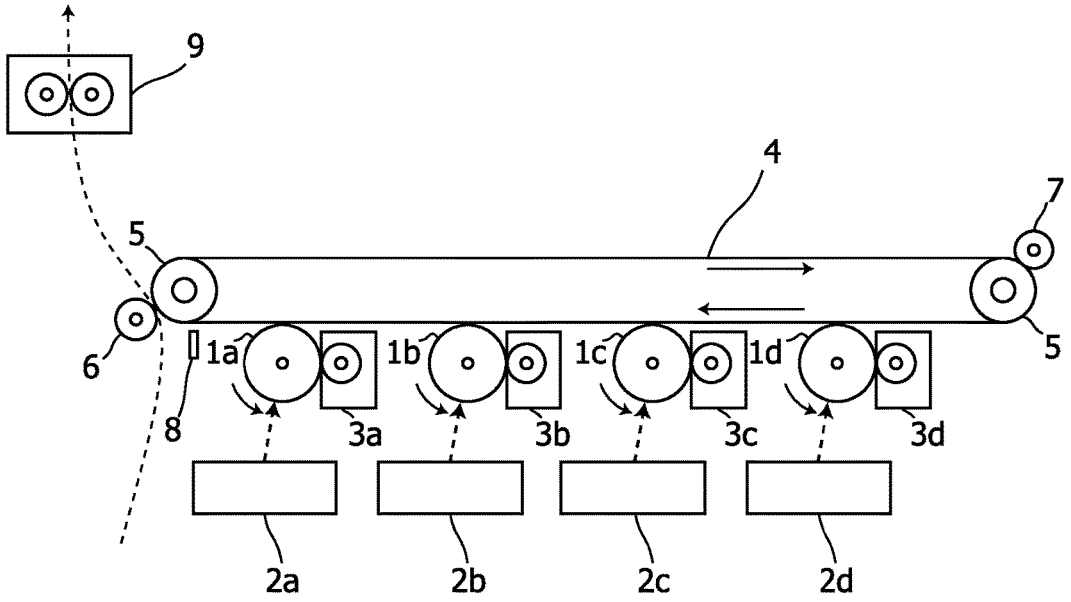
FIG. 1 shows a side view that indicates an internal mechanical configuration of an image forming apparatus in an embodiment according to the present disclosure.

FIG. 1 shows a side view that indicates an internal mechanical configuration of an image forming apparatus in an embodiment according to the present disclosure. The image forming apparatus shown in FIG. 1 is an apparatus having an electrographic-type printing function such as a printer, a facsimile machine, a copier, or a multi function peripheral.

The image forming apparatus in the present embodiment includes a tandem-type color development device. This color development device includes photoconductor drums 1*a* to 1*d*, exposure devices 2*a* to 2*d*, and development devices 3*a* to 3*d* for respective colors. The photoconductor drums 1*a* to 1*d* are photoconductors of four colors: Cyan, Magenta, Yellow and Black. The exposure devices 2*a* to 2*d* are devices that form electrostatic latent images by irradiating the photoconductor drums 1*a* to 1*d* with laser light. Each of the exposure devices 2*a* to 2*d* includes a laser diode as a light emitter of the laser light, optical elements (such as lens, mirror and polygon mirror) that guide the laser light to the photoconductor drum 1*a*, 1*b*, 1*c*, or 1*d*.

Further, in the periphery of each one of the photo conductor drums 1*a* to 1*d*, a charging unit, a cleaning device, a static electricity eliminator and the like are disposed. The charging device is of a scorotron type or the like and charges the photoconductor drum 1*a*, 1*b*, 1*c*, or 1*d*. The cleaning device removes residual toner on each one of the photo conductor drums 1*a* to 1*d* after primary transfer. The static electricity eliminator eliminates static electricity of each one of the photo conductor drums 1*a* to 1*d* after primary transfer.

Toner containers are attached to the development devices 3*a* to 3*d*, and the toner containers are filled up with toner of four colors: Cyan, Magenta, Yellow and Black, respectively. Development biases are applied to the development devices 3*a* to 3*d*, respectively, and thereby on the basis of a difference between potentials of the development devices 3*a* to 3*d* and the photoconductor drums 1*a* to 1*d*, the development devices 3*a* to 3*d* cause the toner supplied from the toner containers to adhere to electrostatic latent images on the photoconductor drums 1*a* to 1*d*, respectively, and consequently form toner images of the four colors. For example, the toner composes a developer together with carrier.

The photoconductor drum 1*a*, the exposure device 2*a* and the development device 3*a* perform development of Magenta. The photoconductor drum 1*b*, the exposure device 2*b* and the development device 3*b* perform development of Cyan. The photoconductor drum 1*c*, the exposure device 2*c* and the development device 3*c* perform development of Yellow. The photoconductor drum 1*d*, the exposure device 2*d* and the development device 3*d* perform development of Black.

Figure 2:
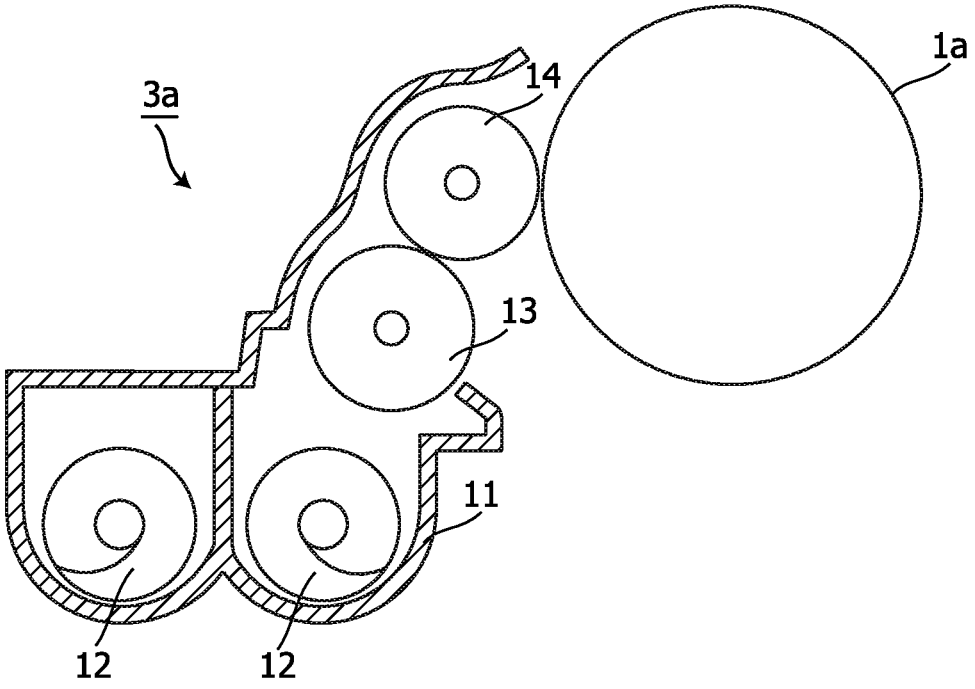
FIG. 2 shows a cross-sectional diagram that indicates an example of the development device 3*a* in FIG. 1.

FIG. 2 shows a cross-sectional diagram that indicates an example of the development device 3*a* in FIG. 1. FIG. 2 shows the development device 3*a*, and the development device 3*b*, 3*c* or 3*d* has the same configuration.

As shown in FIG. 2, the development device 3*a* includes a housing 11, agitation screws 12, a magnetic roller 13, and a development roller 14.

An unshown toner container is connected to the development device 3*a*, and toner is supplied from the toner container via an unshown supply port into the housing 11. In the housing 11, the agitation screws 12 agitate two-component developer composed by the toner and carrier. As the carrier, a magnetic material is used.

The magnetic roller 13 keeps the two-component developer forming a brush shape on a surface thereof. The toner in the two-component developer is transferred to the development roller 14 in accordance with a transportation bias that is a voltage between the magnetic roller 13 and the development roller 14.

The development roller 14 keeps the toner transferred from the magnetic roller 13 as a thin toner layer on a surface thereof. A development bias is applied to the development roller 14, and thereby the toner layer formed on the surface of the development roller 14 is transferred to the photoconductor drum 1*a* by a potential of the photoconductor drum 1*a* from the development roller 14 (i.e. a difference between the development bias and the surface potential of the photoconductor drum 1*a*). Thus, the development roller 14 supplies the toner to an electrostatic latent image on the photoconductor drum 1*a*.

Returning to FIG. 1, the intermediate transfer belt 4 is an image carrier that carries a toner image transferred from the photoconductor drums 1*a* to 1*d*, and is an endless (i.e. loop-shaped) intermediate transfer member. The intermediate transfer belt 4 is hitched around driving rollers 5, and rotates by driving force of the driving rollers 5 towards the direction from the contact position with the photoconductor drum 1*d* to the contact position with the photoconductor drum 1*a*.

In the calibration, a solid toner patch (i.e. a toner pattern with a uniform constant density in a patch) is formed on the photoconductor drum 1*a*, 1*b*, 1*c* or 1*d*, and the toner patch is transferred to the intermediate transfer belt 4, and carried by the intermediate transfer belt 4.

A transfer roller 6 causes a conveyed paper sheet to contact the transfer belt 4, and secondarily transfers the toner image on the transfer belt 4 to the paper sheet. The paper sheet on which the toner image has been transferred is conveyed to a fuser 9, and consequently, the toner image is fixed on the paper sheet.

A roller 7 has a cleaning brush, and removes residual toner on the intermediate transfer belt 4 by contacting the cleaning brush to the intermediate transfer belt 4 after transferring the toner image to the paper sheet. Instead of the roller 7 having a cleaning brush, a cleaning blade may be used.

A sensor 8 is a reflection-type optical sensor and irradiates the intermediate transfer belt 4 with light and detects its reflection light in order to measure a toner density in the calibration. Specifically, the sensor 8 irradiates with light a predetermined area where a test toner pattern (i.e. the aforementioned toner patch) passes, detects its reflection light, and outputs an electrical signal corresponding to the detected intensity of the reflection light.

Figure 3:
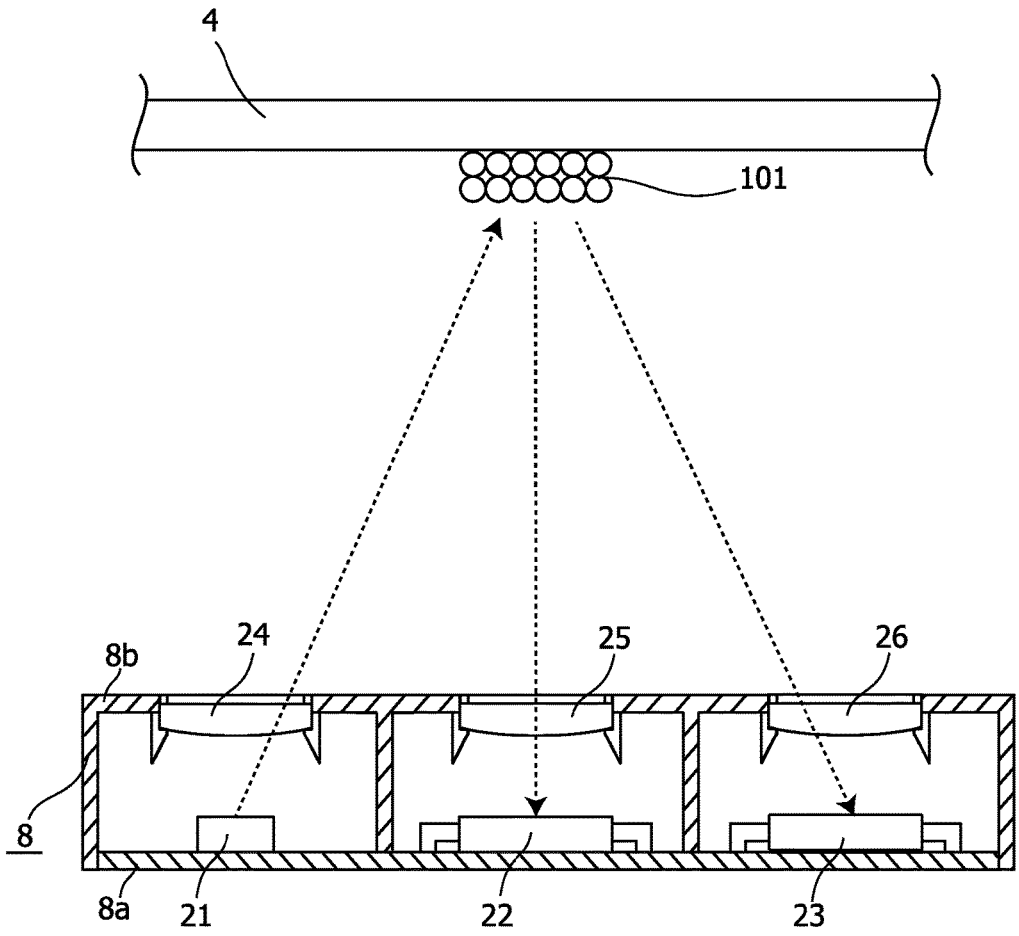
FIG. 3 shows a diagram that indicates an example of a configuration of a sensor 8 shown in FIG. 1.

FIG. 3 shows a diagram that indicates an example of a configuration of a sensor 8 shown in FIG. 1.

The sensor 8 shown in FIG. 3 includes a circuit board 8*a* and a sensor cover 8*b*, and the circuit board 8*a* is equipped with the sensor cover 8*b*. A chip-shaped light emitter 21 and chip-shaped photodetectors 22 and 23 are surface-mounted on the circuit board 8*a*, and the sensor cover 8*b* has three holes, and focusing lenses 24, 25 and 26 are arranged at positions corresponding to these holes, and corresponds to the light emitter 21 and the photodetectors 22 and 23, respectively.

The light emitter 21 outputs light and irradiates a toner pattern on the intermediate transfer belt 4 or a surface material of the intermediate transfer belt 4 with the light through the focusing lens 24. The photodetector 22 receives diffuse reflection light in reflection light from the toner pattern or the surface material, of the light outputted by the light emitter 21. The photodetector 23 receives specular reflection light in reflection light from the toner pattern or the surface material, of the light outputted by the light emitter 21. For example, the light emitter 21 is a light emitting diode, and the photodetectors 22 and 23 are photo diodes or photo transistors.

The sensor 8 is not limited to the configuration shown in FIG. 3, and may be another reflection-type optical sensor that separates the reflection light into a P component and an S component and measures light intensities of the P and S components.

Figure 4:
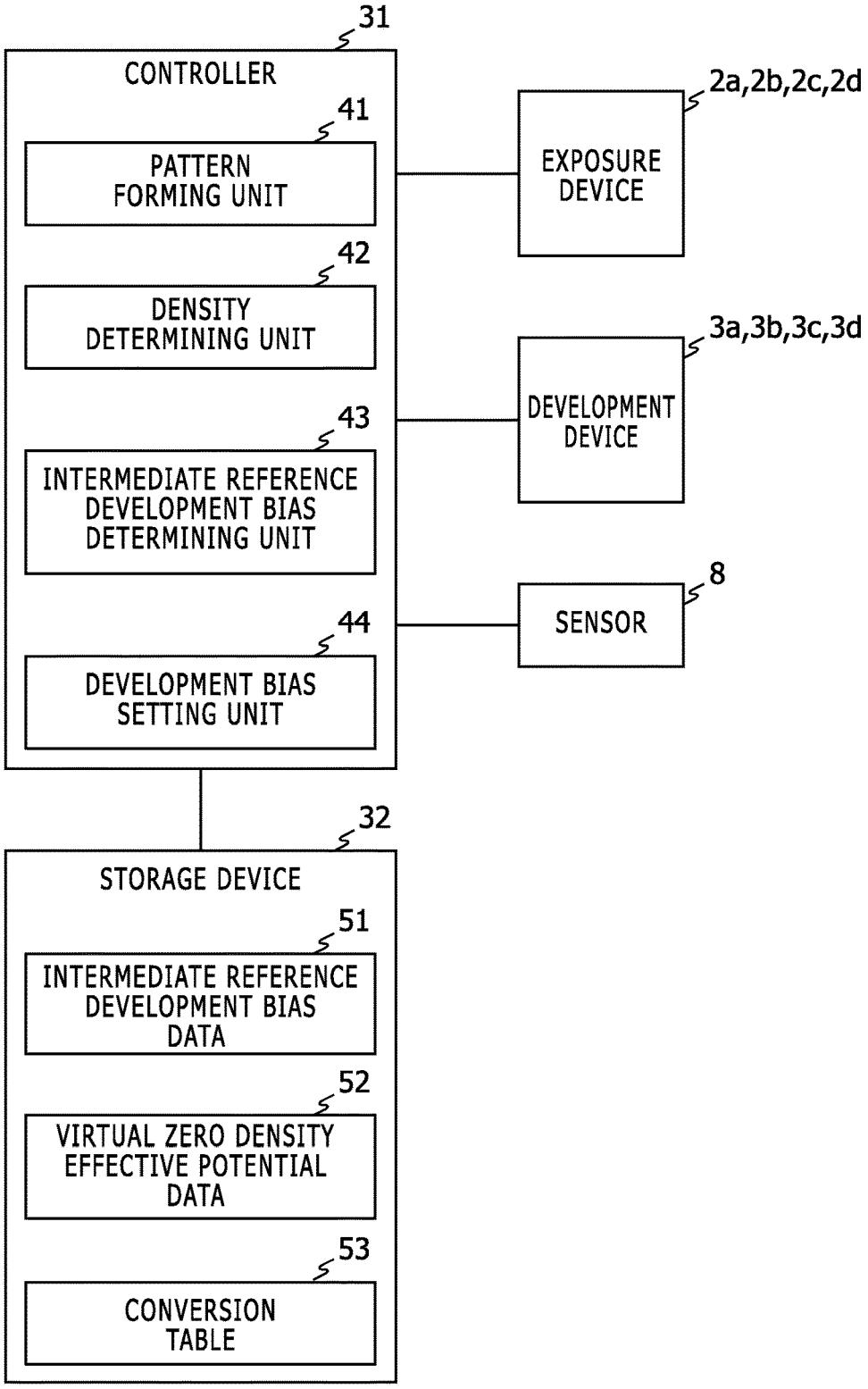
FIG. 4 shows a block diagram that indicates an electronic configuration of the image forming apparatus in the embodiment according to the present disclosure.

FIG. 4 shows a block diagram that indicates an electronic configuration of the image forming apparatus in the embodiment according to the present disclosure. In FIG. 4, the controller 31 controls a driving source that drives the aforementioned rollers, a bias induction circuit that induces a primary transfer bias, the development devices 3*a* to 3*d*, the exposure devices 2*a* to 2*d* and the like, and thereby performs developing, transferring and fixing the toner image, feeding a paper sheet, printing on the paper sheet, and outputting the paper sheet. The primary transfer bias is induced between the photoconductor drums 1*a* to 1*d* and the intermediate transfer belt 4, respectively. The controller 31 is a processing circuit that for example, includes a computer that acts in accordance with a control program, an ASIC (Application Specific Integrated Circuit) and/or the like. Furthermore, the storage device 32 is a non volatile storage device such as a flash memory, and stores sorts of data and the aforementioned control program.

Further, the controller 31 performs the calibration of density gradation, maximum density and/or the like at regular intervals or at specific timing. A D/A (Digital to Analog) converter, an amplifier and the like are disposed at an output part of the controller 31 if necessary. An amplifier, an A/D (Analog to Digital) converter, and the like are disposed at an input part of the controller 31 if necessary.

The controller 31 includes a pattern forming unit 41, a density determining unit 42, an intermediate reference development bias determining unit 43, and a development bias setting unit 44.

Further, in the storage device, intermediate reference density data 51, virtual zero density effective potential data 52, and a conversion table 53 are stored. The intermediate reference density data 51 is data that indicates an intermediate reference density. The virtual zero density effective potential data 52 is data that indicates a virtual zero density effective potential that is a difference between a development bias and a bright potential of the photo conductor drum 1*a*, 1*b*, 1*c* or 1*d* when a transmission density is virtually zero. The virtual zero density effective potential is measured in advance in an experiment or the like. The conversion table 53 is a table to convert one to the other among a transmission density and a CTD at each development bias. Instead of the conversion table 53, used is data that indicates a conversion formula to convert one to the other among a transmission density and a CTD at each development bias.

In the calibration, the pattern forming unit 41 controls the exposure devices 2*a* to 2*d*, the development devices 3*a* to 3*d* and the like and thereby forms test toner patterns (i.e. the aforementioned toner patches) of respective toner colors on the intermediate transfer belt 4.

The density determining unit 42 determines a toner density on the basis of outputs of the photodetectors 22 and in the sensor 8. The density determining unit 42 calculates a coverage factor, a CTD (Color Toner Density) or the like as the toner density.

The coverage factor M is expressed as the following formula. $M=1-\{(R-Rd)-(D-Dd)\}/\{(Rg-Rd)-(Dg-Dd)\}$ Here, Rd is a dark potential of a specular-reflection-light photodetector (e.g. the aforementioned photodetector 23), Dd is a dark potential of a diffuse-reflection-light photodetector (e.g. the aforementioned photodetector 22), Rg is a detection voltage of specular reflection light from the surface material (e.g. an output voltage of the aforementioned photodetector 23), Dg is a detection voltage of diffuse reflection light from the surface material (e.g. an output voltage of the aforementioned photodetector 22), R is a detection voltage of specular reflection light from the toner part, and D is a detection voltage of diffuse reflection light from the toner part.

Further, the CTD is a factor obtained by normalizing the coverage factor M into a range between 0 and 1000.

The intermediate reference development bias determining unit 43 adjusts the development bias and thereby determines as an intermediate reference development bias value a value of the development bias so that a toner density (a CTD or the like) based on an output of the sensor 8 is equal to an intermediate reference density lower than a target density.

Figure 5:
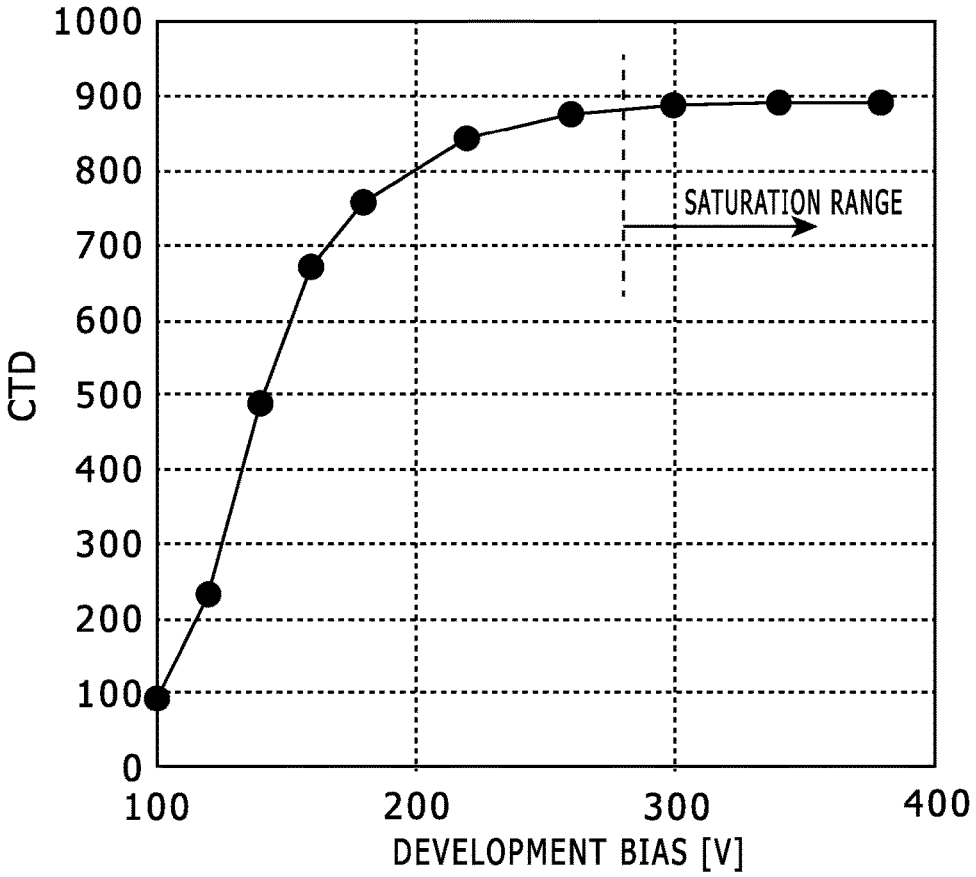
FIG. 5 shows a diagram that indicates an example of a characteristic of CTD for a development bias.

FIG. 5 shows a diagram that indicates an example of a characteristic of CTD to a development bias. As shown in FIG. 5, when using the sensor 8 of the reflection type, even if a toner adhesion amount is increased by increasing the development bias, the CTD is saturated in a high density range.

In such characteristic, a target density is set as a density within such saturation range. The intermediate reference density is out of the saturation range and set as a density near the saturation range. Further, the intermediate reference density is a predetermined density lower than the saturation range in a toner density characteristic (a characteristic of the CTD, the coverage factor M or the like) based on output of the sensor 8 for the development bias. For example, in a case shown in FIG. 5, the target density is set as a density corresponding to CTD=885, and the intermediate reference density is set as a density corresponding to CTD=820. Thus, the intermediate reference density is set as a density in a range with high sensitivity of the CTD to the development bias.

For example, the intermediate reference development bias determining unit 43 (*a*) changes the development bias while the other process conditions are fixed and forms plural toner patches at different development biases using the pattern forming unit 41, (b) determines a density (a CTD or the like) of each of toner patches using the density determining unit 42, and (c) determines as the intermediate reference development bias value a development bias value corresponding to an intermediate reference density specified by the intermediate reference density data 51, using interpolation or the like on the basis of development biases corresponding to the determined densities (CTDs or the like) of the plural toner patches.

If the intermediate reference density indicated by the intermediate reference density data 51 is expressed in the transmission density TD, then here, the intermediate reference density indicated by the intermediate reference density data 51 is converted to CTD or the like on the basis of the conversion table 53.

The development bias setting unit 44 (*a*) determines a bright potential of the photoconductor drum 1*a*, 1*b*, 1*c* or 1*d* at the calibration, (b) determines as an intermediate reference effective potential a difference between the determined intermediate reference development bias value and the bright potential at the calibration, and (c) determines a development bias value corresponding to the target density by linear interpolation based on the virtual zero density effective potential based on the virtual zero density effective potential data 52 (i.e. an effective potential when a transmission density is zero) and the intermediate reference effective potential (i.e. an effective potential when a transmission density is equal to the intermediate reference density), namely determines development bias corresponding to an effective potential when a transmission density is equal to the target density.

It should be noted that the bright potential of the photoconductor drum 1*a*, 1*b*, 1*c* or 1*d* is a lowermost potential at a position irradiated by the exposure device 2*a*, 2*b*, 2*c* or 2*d* after charging this photoconductor drum 1*a*, 1*b*, 1*c* or 1*d*.

Further, if the target density is specified with a toner density based on an output of the sensor 8, such as CTD, then on the basis of the conversion table 53, the target density is converted from a CTD or the like to a transmission density TD.

Figure 6:
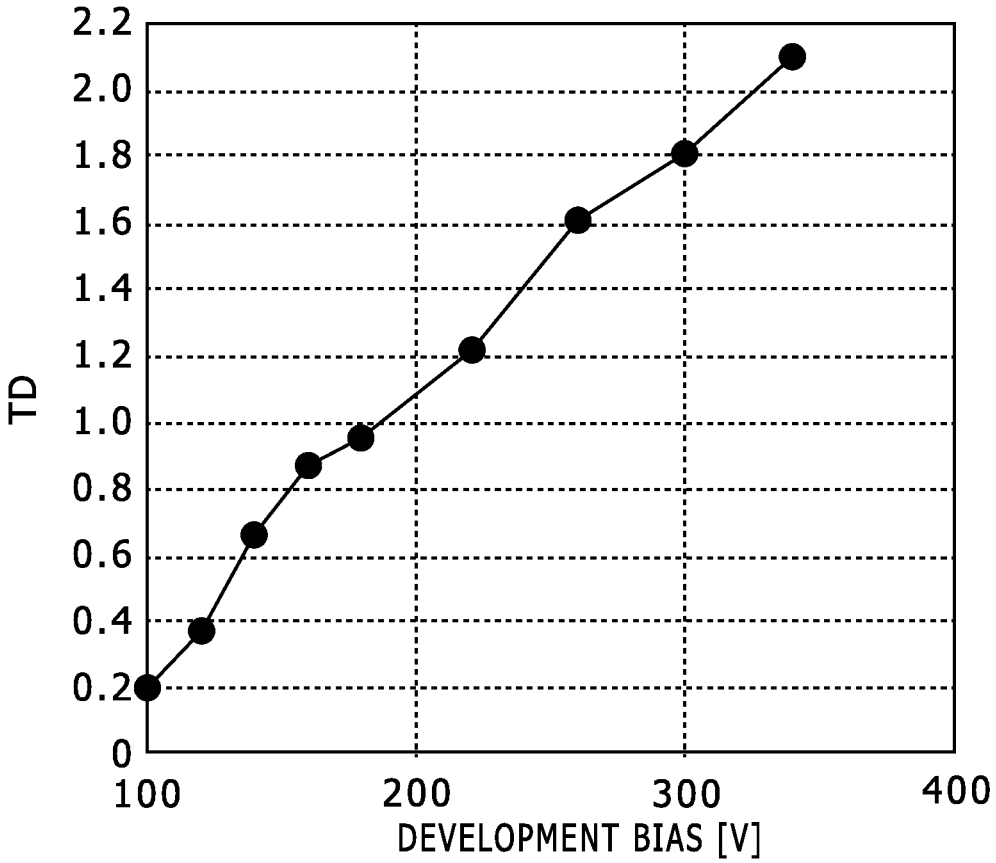
FIG. 6 shows a diagram that indicates an example of a characteristic of a transmission density TD for a development bias.

FIG. 6 shows a diagram that indicates an example of a characteristic of a transmission density TD for a development bias. As shown in FIG. 6, a characteristic of a transmission density TD corresponding to a development bias is not a saturation characteristic different from CTD, and in this characteristic, linearization is possible even near the target density. In general, a transmission density TD corresponding to each development bias can not be measured in an actual apparatus, and therefore is measured in an experiment.

Figure 7:
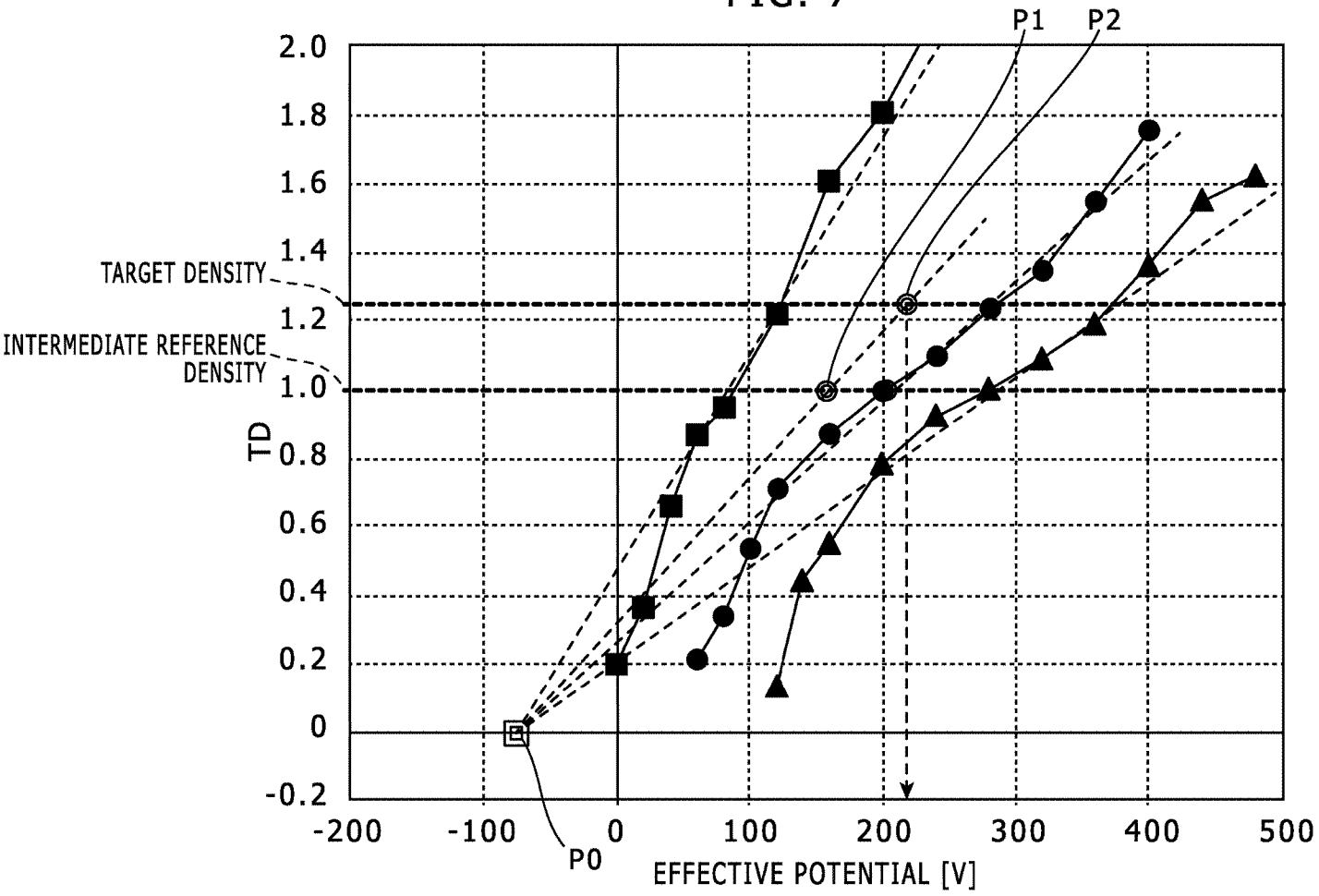
FIG. 7 shows a diagram that indicates an example of a characteristic of a transmission density TD for an effective potential (i.e. a difference between a development bias and a bright potential of the photoconductor drum 1*a*) in plural conditions.

FIG. 7 shows a diagram that indicates an example of a characteristic of a transmission density TD for an effective potential of the photoconductor drum (i.e. a difference between a development bias and a bright potential of the photo conductor drum 1*a*) in plural conditions. FIG. 7 indicates three characteristics (a characteristic expressed with a series of black circle points, a characteristic expressed with a series of black rectangle points, and a characteristic expressed with a series of black triangle points). In the plural conditions shown in FIG. 7, at least one of: (a) temperature and humidity and (b) a charging characteristic of the photoconductor drum is different from each other.

The characteristic of a transmission density TD for an effective potential in each condition is obtained from (a) a bright potential of the photoconductor drum measured in this condition and (b) a values of the transmission density TD corresponding to plural development bias values measured in this condition.

In the characteristic of a transmission density TD, an approximate linear expression (i.e. each straight broken line in FIG. 7) is determined by linearization of a characteristic near the aforementioned target density and the intermediate reference density, and using the linear expression, an effective potential at virtually zero transmission density (i.e. the point P0 expressed with doubled rectangles in FIG. 7) is determined as the virtual zero density effective potential.

As mentioned, the virtual zero density effective potential is an effective potential at a virtually zero transmission density obtained by linear interpolation from a characteristic of the transmission density for an effective potential in a specific condition.

In this embodiment, the virtual zero density effective potential is an effective potential at a virtually zero transmission density obtained by linear interpolation based on at least a range between the target density and the intermediate reference density in the characteristic. Specifically, for example, an approximate linear expression is derived using a least squares method or the like in a range that includes at least a range between the target density and the intermediate reference density, and on the basis of the approximate linear expression, an effective potential at zero transmission density is derived.

As shown in FIG. 7, the virtual zero density effective potential is substantially constant even in different conditions from each other (i.e. even if a bright potential changes of the photoconductor drum). For example, plural values of the virtual zero density effective potential are obtained in plural conditions, and an average value of the plural values of the virtual zero density effective potential is stored as the virtual zero density effective potential data 52, and used as virtual zero density effective potential.

Therefore, as mentioned, an effective potential (the point P0 in FIG. 7) when virtually making a transmission density be zero at a reference state (an initial state) as zero is determined in advance and prepared as the virtual zero density effective potential data 52; and at the calibration, (a) a bright potential and an intermediate reference development bias value of the photoconductor drum 1*a*, 1*b*, 1*c* or 1*d* are measured, (b) an intermediate reference effective potential is determined from this measurement, (c) an effective potential (the point P2 in FIG. 7) corresponding to a target density is determined by linear interpolation with a straight line that passes both the point P0 based on the virtual zero density effective potential data 52 and the point P1 based on the measured intermediate reference effective potential, and (d) a development bias corresponding to the target density is determined by adding the bright potential at the calibration to this effective potential.

The following part explains a behavior of the aforementioned image forming apparatus.

When a predetermined timing of the calibration comes, the controller 31 performs the calibration.

In the calibration, firstly the intermediate reference development bias determining unit 43 determines an intermediate reference effective potential corresponding to an intermediate reference density specified by the intermediate reference density data 51 using the pattern forming unit 41 and the density determining unit 42.

Further, the development bias setting unit 44 measures a bright potential of the photoconductor drum 1*a*, 1*b*, 1*c* or 1*d*, and reads the virtual zero density effective potential data 52 and thereby determines a virtual zero density effective potential (i.e. an effective potential when virtually making a transmission density of a toner patch be zero).

Subsequently, as shown in FIG. 7, the development bias setting unit 44 determines an effective potential (the point P2) corresponding to a target density by linear interpolation (i.e. extrapolation) based on the virtual zero density effective potential (the P0) and the determined intermediate reference effective potential (the point P1), determines a development bias corresponding to the target density by adding the measured bright potential to the determined effective potential, and sets the determined development bias to the development device 3*a*, 3*b*, 3*c* or 3*d*.

For each of the development devices 3*a*, 3*b*, 3*c* and 3*d* for each toner color, the development bias value is independently determined and set in the aforementioned manner.

As mentioned, in this embodiment, the controller 31 (*a*) determines a bright potential of the photoconductor drum 1*a*, 1*b*, 1*c* or 1*d* at calibration, (b) adjusts the development bias and thereby determines as an intermediate reference development bias value a value of the development bias so that a toner density based on an output of the reflection-type optical sensor 8 is equal to an intermediate reference density lower than a target density, (c) determines as an intermediate reference effective potential a difference between the intermediate reference development bias value and the bright potential at calibration, and (d) determines a development bias value corresponding to the target density by linear interpolation based on the intermediate reference effective potential and a virtual zero density effective potential that is a difference between a development bias and a bright potential of the photoconductor drum when a transmission density is virtually zero.

Consequently, even if fluctuation of a toner charging amount occurs due to usage environment (temperature, humidity and/or the like) or coating thickness of the photoconductor drum 1*a*, 1*b*, 1*c* and 1*d* decreases by use, the development bias is properly set in the calibration by taking account into change of the bright potential.

Figure 8:
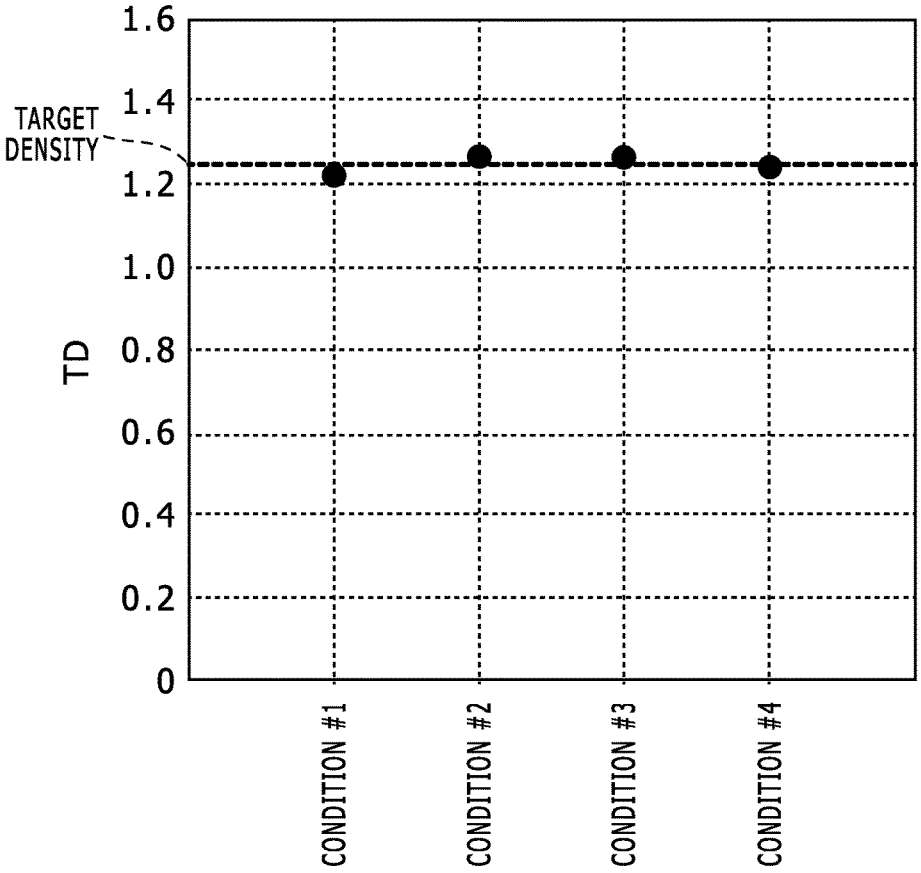
FIG. 8 shows a diagram that indicates calibration results in plural conditions.

FIG. 8 shows a diagram that indicates calibration results in plural conditions. In the conditions #1 to #4, the development device is of the two-component developer type, the photoconductor drum is positive charging single layer organic photoconductor, and the process line velocity is 165 mm/sec. Further, in the condition #1, the drum coating thickness is 30 micro meters and the temperature is 23 degrees Celsius, and the humidity is 50%. Furthermore, in the condition #2, the drum coating thickness is 30 micro meters and the temperature is 10 degrees Celsius, the humidity is 15%, and the drum charging amount is set as a higher value. Furthermore, in the condition #3, the drum coating thickness is 30 micro meters and the temperature is degrees Celsius, the humidity is 85%, and the drum charging amount is set as a lower value. Furthermore, in the condition #4, the drum coating thickness is 14 micro meters. As shown in FIG. 8, the calibration performed in the aforementioned manner causes the toner density to be accurately adjusted to a target density in plural conditions.

It should be understood that various changes and modifications to the embodiments described herein will be apparent to those skilled in the art. Such changes and modifications may be made without departing from the spirit and scope of the present subject matter and without diminishing its intended advantages. It is therefore intended that such changes and modifications be covered by the appended claims.

What is claimed is:

1. An image forming apparatus, comprising:

a photoconductor drum;

a development roller configured to supply toner to an electrostatic latent image on the photoconductor drum;

an image carrier configured to carry a toner patch transferred from the photoconductor drum;

a reflection-type optical sensor configured to irradiate the toner patch with light and receive reflection light from the toner patch; and a controller configured to set a development bias applied to the development roller, wherein the controller (a) determines a bright potential of the photoconductor drum at calibration, (b) adjusts the development bias and thereby determines as an intermediate reference development bias value a value of the development bias so that a toner density based on an output of the reflection-type optical sensor is equal to an intermediate reference density lower than a target density, (c) determines as an intermediate reference effective potential a difference between the intermediate reference development bias value and the bright potential at calibration, and (d) determines a development bias value corresponding to the target density by linear interpolation based on the intermediate reference effective potential and a virtual zero density effective potential, the virtual zero density effective potential being a difference between a development bias and a bright potential of the photoconductor drum when a transmission density is virtually zero, wherein the virtual zero density effective potential is an effective potential at a virtually zero transmission density obtained by linear interpolation from a characteristic of the transmission density for an effective potential in a specific condition, and the effective potential is a difference between a development bias in the specific condition and a bright potential of the photoconductor drum in the specific condition.

2. The image forming apparatus according to claim 1, wherein the virtual zero density effective potential is an effective potential at a virtually zero transmission density obtained by linear interpolation based on at least a range between the target density and the intermediate reference density in the characteristic.

3. The image forming apparatus according to claim 1, wherein the intermediate reference density is a predetermined density lower than a saturation range in a toner density characteristic based on output of the reflection-type optical sensor for the development bias.

* * * * *